US012791264B2

(12) United States Patent
Zhao et al.

(10) Patent No.: US 12,791,264 B2
(45) Date of Patent: Nov. 10, 2026

(54) HEAT EXCHANGER

(71) Applicant: SANHUA (HANGZHOU) MICRO CHANNEL HEAT EXCHANGER CO., LTD., Hangzhou (CN)

(72) Inventors: Lei Zhao, Hangzhou (CN); Aiping Cao, Hangzhou (CN); Jianlong Jiang, Hangzhou (CN); Junfeng Jin, Hangzhou (CN)

(73) Assignee: SANHUA (HANGZHOU) MICRO CHANNEL HEAT EXCHANGER CO., LTD., Hangzhou (CN)

( * ) Notice: Subject to any disclaimer, the term of this patent is extended or adjusted under 35 U.S.C. 154(b) by 158 days.

(21) Appl. No.: 18/613,353

(22) Filed: Mar. 22, 2024

(65) Prior Publication Data

US 2024/0328724 A1 Oct. 3, 2024

(30) Foreign Application Priority Data

Mar. 31, 2023 (CN) ..... 202320698856.5

(51) Int. Cl.
*F28F 1/02* (2006.01)
*F28D 1/053* (2006.01)

(52) U.S. Cl.
CPC ..... *F28F 1/022* (2013.01); *F28D 1/05391* (2013.01)

(58) Field of Classification Search
CPC ..... F28D 1/05391; F28F 1/022; F28F 1/025; F28F 9/0282; F28F 1/006; F28F 9/182
See application file for complete search history.

(56) References Cited

U.S. PATENT DOCUMENTS

| | | | | |
|---|---|---|---|---|
| 5,479,985 | A * | 1/1996 | Yamamoto | F28D 1/05391 165/176 |
| 6,073,686 | A * | 6/2000 | Park | F28F 9/0221 165/110 |
| 8,739,855 | B2 | 6/2014 | Fritz et al. | |
| 9,267,737 | B2 * | 2/2016 | Matter, III | F28D 1/05383 |
| 11,927,404 | B2 * | 3/2024 | Tong | F28D 1/0391 |
| 2008/0141707 | A1 * | 6/2008 | Knight | F28F 1/025 165/174 |

(Continued)

FOREIGN PATENT DOCUMENTS

| | | | | |
|---|---|---|---|---|
| CN | 112524986 | A * | 3/2021 | H05K 7/20254 |
| WO | WO-2014181687 | A1 * | 11/2014 | F28D 1/05383 |

OTHER PUBLICATIONS

CN112524986A mt Mar. 2021.*

(Continued)

*Primary Examiner* — Gordon A Jones
(74) *Attorney, Agent, or Firm* — Bridgeway IP Law Group, PLLC; Jihun Kim

(57) ABSTRACT

A heat exchanger includes a first tube, a second tube, an inlet tube, and a heat exchange tube. The first tube and the second tube extend along a length direction of the heat exchanger, the inlet tube is connected to the first tube, and the first heat exchange tube has a plurality of flow channels. Two ends of the first heat exchange tube are correspondingly inserted into a tube cavity of the first tube and a tube cavity of the second tube, a section of the first heat exchange tube inserted into the first tube has a flow inlet, and a first part of the flow inlet has a height difference relative to a second part of the flow inlet in a height direction of the heat exchanger.

15 Claims, 17 Drawing Sheets

(56) References Cited

U.S. PATENT DOCUMENTS

| | | | | |
|---|---|---|---|---|
| 2010/0018231 | A1* | 1/2010 | Haller | F28D 1/0341 62/515 |
| 2024/0210077 | A1* | 6/2024 | Joardar | F28D 1/0443 |
| 2025/0102242 | A1* | 3/2025 | Li | F28D 1/0476 |

OTHER PUBLICATIONS

WO2014181687A1 mt Nov. 2014.*
Roger Valdes Fernandez, "Office Action for Mexico Application No. MX/u/2024/000128", Oct. 23, 2024, IMPI, Mexico.

* cited by examiner

HEAT EXCHANGER

CROSS-REFERENCE TO RELATED APPLICATION

This application is based on and claims priority to Chinese Patent Application No. 202320698856.5 filed on Mar. 31, 2023, the entire contents of which are incorporated herein by reference for all purposes.

FIELD

The present disclosure relates to a field of heat exchange technologies, and more particularly to a heat exchanger.

BACKGROUND

A refrigerant vapor in a compression system will become into a gas-liquid two-phase state after passing through a throttling device and then arrives at an inlet of an evaporator. The gas-liquid separation of the gas-liquid two-phase refrigerant will lead to uneven distribution of the refrigerant entering the heat exchange tube. Some channels have less liquid flow rate and evaporate prematurely, thus resulting in a too large superheat at the channel outlet. However, some channels have too much liquid flow rate, thus resulting in a too little superheat at the channel outlet. Both of the above two make the heat exchange area of the evaporator not fully utilized. Thus, whether the two-phase refrigerant fluid, especially the liquid in it, can be evenly distributed into each channel for heat exchange is the key for the design and structure of the evaporator.

SUMMARY

Embodiments of the present disclosure propose a heat exchanger. The heat exchanger according to the embodiments of the present disclosure includes a first tube, a second tube, an inlet tube, and a heat exchange tube. The first tube extends along a length direction of the heat exchanger, and the second tube extends along the length direction of the heat exchanger. The inlet tube is connected to the first tube, and the first heat exchange tube has a plurality of flow channels. Two ends of the first heat exchange tube are correspondingly inserted into a tube cavity of the first tube and a tube cavity of the second tube. A section of the first heat exchange tube inserted into the first tube has a flow inlet, and a first part of the flow inlet has a height difference relative to a second part of the flow inlet in a height direction of the heat exchanger.

DETAILED DESCRIPTION

Figure 1:
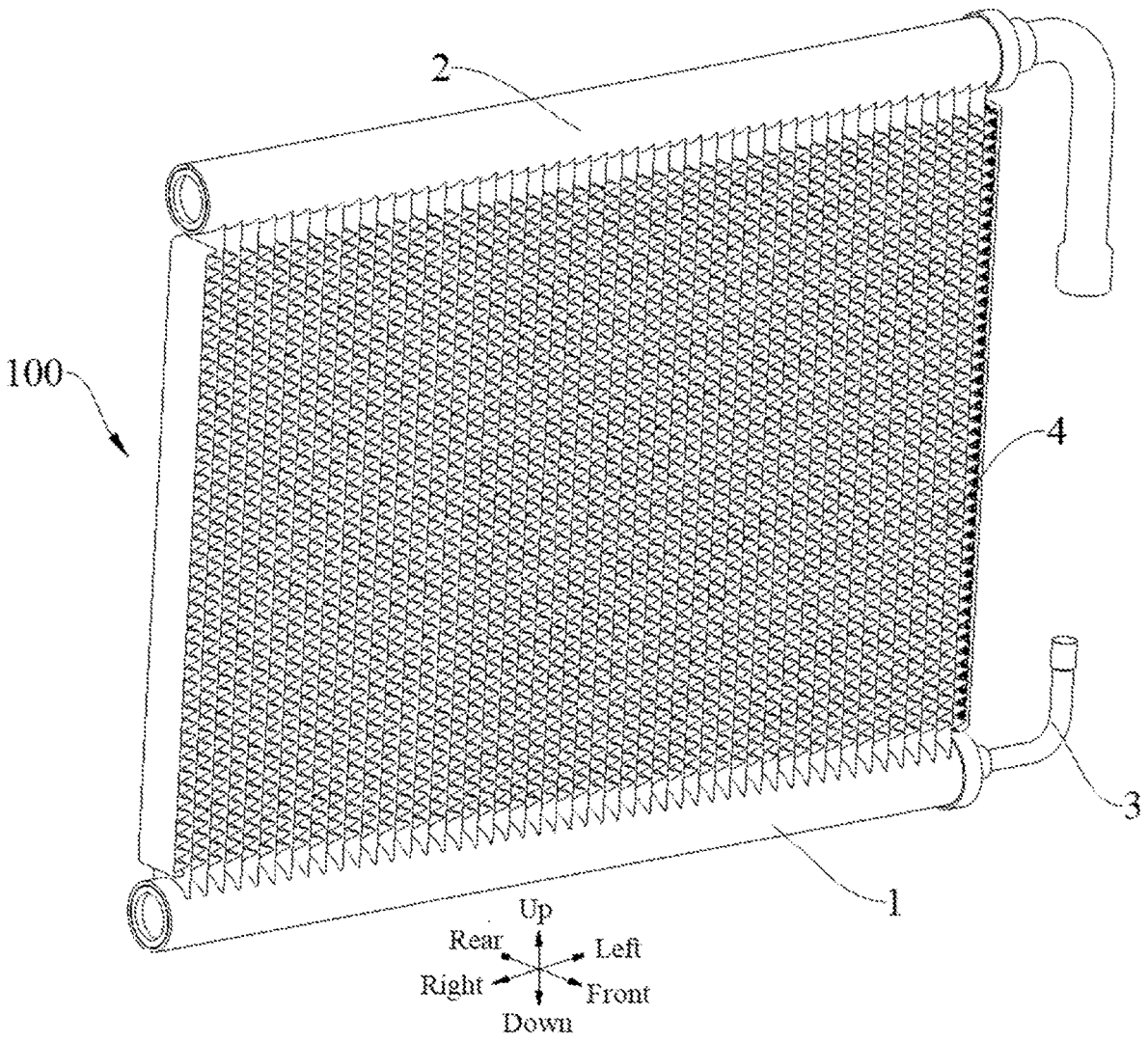
FIG. 1 is a perspective view of a heat exchanger according to an embodiment of the present disclosure, wherein a first tube is located below a second tube.

Embodiments of the present disclosure are described in detail below, examples of which are shown in the accompanying drawings. The following embodiments described with reference to the accompanying drawing are illustrative. It should be understood that the embodiments described are intended to explain the present disclosure, but not to limit the present disclosure.

A heat exchanger 100 according to embodiments of the present disclosure is described below with reference to FIGS. 1 to 17.

The heat exchanger 100 according to the embodiments of the present disclosure includes a first tube 1, a second tube 2, an inlet tube 3, and a heat exchange tube 4.

The first tube 1 extends along a length direction of the heat exchanger 100, and the second tube 2 extends along the length direction of the heat exchanger 100 (a left-right direction shown in FIG. 1). The inlet tube 3 is connected to the first tube 1. The first heat exchange tube 4 has a plurality of flow channels, two ends of the first heat exchange tube 4 are correspondingly inserted into a tube cavity of the first tube 1 and a tube cavity of the second tube 2, a section of the first heat exchange tube 4 inserted into the first tube 1 has a flow inlet, and a first part of the flow inlet has a height difference relative to a second part of the flow inlet in a height direction of the heat exchanger 100 (such as an up-down direction shown in FIG. 1).

In the embodiments of the present disclosure, the height direction of the heat exchanger 100 means that when the heat exchanger 100 is in use, the first tube 1 is arranged in a horizontal direction, that is, a length direction of the first tube 1 is generally parallel to the horizontal direction, and a vertical direction at this time is the height direction of the heat exchanger 100.

The flow inlet is defined as a port through which the liquid or gaseous refrigerant flows into the first heat exchange tube 4. The liquid or gaseous refrigerant may flow into a tube cavity of the first heat exchange tube 4 through this flow inlet, and then flow into the second tube 2.

When the refrigerant enters the first tube from the inlet tube 3, part of the gaseous refrigerant will be mixed into the liquid refrigerant. Therefore, when the liquid refrigerant mixed with the gaseous refrigerant enters the first tube 1 from the inlet tube 3, the cavitation will occur. As a result, the refrigerant in the first tube 1 is stirred and is unable to be evenly and timely distributed into each flow channel of the first heat exchange tube 4. Furthermore, the refrigerant continuously enters part of the flow channels of the first heat exchange tube 4 due to the cavitation, resulting in an excessive flow rate in the part of the flow channels and a corresponding increase in a flow speed of the refrigerant in the tube cavity. Thus, part of the liquid refrigerant that has not evaporated timely may be carried to an outlet of the evaporator, thereby resulting in a liquid hammer phenomenon of a compressor and causing damages on the compressor. The other part of the flow channels enters an overheated state prematurely due to the entry of a small amount of the refrigerant.

In the heat exchanger 100 according to the embodiments of the present disclosure, based on the principle of different densities of the liquid refrigerant and the gaseous refrigerant, the first part of the flow inlet of the first heat exchange tube 4 has the height difference relative to the second part of the flow inlet in the height direction of the heat exchanger 100, and the gaseous refrigerant in the first tube 1 is timely discharged through the higher part of the flow inlet, thus avoiding the problem of cavitation caused by the gaseous refrigerant stirring the liquid refrigerant. As a result, the liquid refrigerant may be evenly distributed in the lower part of the flow inlet. That is, the first part of the flow inlet of the first heat exchange tube 4 has the height difference relative to the second part of the flow inlet in the height direction of the heat exchanger 100, which creates a condition for the timely discharge of the gaseous refrigerant in the first tube 1. Thus, the heat exchanger 100 in the embodiments of the present disclosure optimizes the distribution of the refrigerant and improves the heat exchange efficiency of the first heat exchange tube 4.

Therefore, the heat exchanger 100 in the embodiments of the present disclosure has the advantages of optimizing the distribution of the refrigerant and improving the heat exchange efficiency of the first heat exchange tube 4.

Specifically, the first tube 1 is a first header, and the second tube 2 is a second header.

As shown in FIG. 2 to FIG. 4, and FIG. 8 to FIG. 17, the first heat exchange tube includes a first partitioned tube 41 and a second partitioned tube 42 successively arranged along a width direction of the heat exchanger (a front-rear direction shown in FIG. 1), a section of the first partitioned tube 41 inserted into the first tube 1 has a first flow inlet (including a first port 413 and/or a first flow hole 414), a section of the second partitioned tube 42 inserted into the first tube 1 has a second flow inlet (including a second port 421 and a second flow hole 422), and the first flow inlet is lower than the second flow inlet in the height direction of the heat exchanger 100.

In the heat exchanger 100 according to the embodiments of the present disclosure, the first heat exchange tube 4 is divided into the first partitioned tube 41 and the second partitioned tube 42 successively arranged in the width direction of the heat exchanger 4, and the first flow inlet of the first partitioned tube 41 is lower than the second flow inlet of the second partitioned tube 42. Thus, a plurality of flow channels may be formed through spacing by wall surfaces of the first partitioned tube 41 and the second partitioned tube 42 themselves. As a result, this helps to ensure the independence and sealing of the flow channels.

Optionally, the first partitioned tube 41 and the second partitioned tube 42 may be integrally formed or be formed by welding. The embodiments of the present disclosure are not limited to this, and in other embodiments, a partition plate may be arranged in the first heat exchange tube 4 so that the first heat exchange tube 4 is divided into the plurality of flow channels. Therefore, the heat exchanger 100 in the embodiments of the present disclosure has the advantages of a simple structure and a high processing convenience.

Specifically, the flow inlets corresponding to the first partitioned tube 41 and the second partitioned tube 42 are ports that allow the liquid or gaseous refrigerant to flow thereinto accordingly. The first partitioned tube 41 has a first heat exchange cavity, a first flow inlet and a first flow outlet. The second partitioned tube 42 has a second heat exchange cavity, a second flow inlet and a second flow outlet. The first flow inlet of the first partitioned tube 41 is lower than the second flow inlet of the second partitioned tube 42 in the height direction of the heat exchanger 100. In the heat exchanger 100, the gaseous refrigerant in the first tube 1 is timely discharged by the higher second flow inlet of the second partitioned tube 42, thus avoiding the problem of cavitation caused by the gaseous refrigerant stirring the liquid refrigerant. As a result, the liquid refrigerant with a higher cooling efficiency may be evenly distributed in the first flow inlet of the first partitioned tube 41. Therefore, the heat exchanger 100 in the embodiments of the present disclosure has the advantages of optimizing the distribution of the refrigerant and improving the heat exchange efficiency of the first heat exchange tube 4.

As shown in FIG. 2, FIG. 4 to FIG. 6, FIG. 8 and FIG. 9, the first partitioned tube 41 has a first end portion 411 and a second end portion 412 in the height direction of the heat exchanger 100, and the first end portion 411 is inserted in the tube cavity of the first tube 1. In the height direction of the heat exchanger 100, the first end portion 411 is higher than the second end portion 412, and a length of the first partitioned tube 41 inserted into the tube cavity of the first tube 1 is less than a length of the second partitioned tube 42 inserted into the tube cavity of the first tube 1.

In the heat exchanger 100 of the embodiments of the present disclosure, in the height direction of the heat exchanger 100, the first end portion 411 is higher than the second end portion 412, and the length of the first tube 41 inserted into the tube cavity of the first tube 1 is less than the length of the second partitioned tube 42 inserted into the tube cavity of the first tube 1. The uniform distribution of the refrigerant may be realized only by controlling the positions of the second flow inlet of the second partitioned tube 42 and the first flow inlet of the first partitioned tube 41 during installation, and compared with the way of installing the distribution tube, the first heat exchange tube in the heat exchanger 100 in the embodiments of the present disclosure can achieve the distribution of the refrigerant through its own structure. Therefore, the heat exchanger 100 has the advantages of a simple structure and a high installing convenience.

Figure 2:
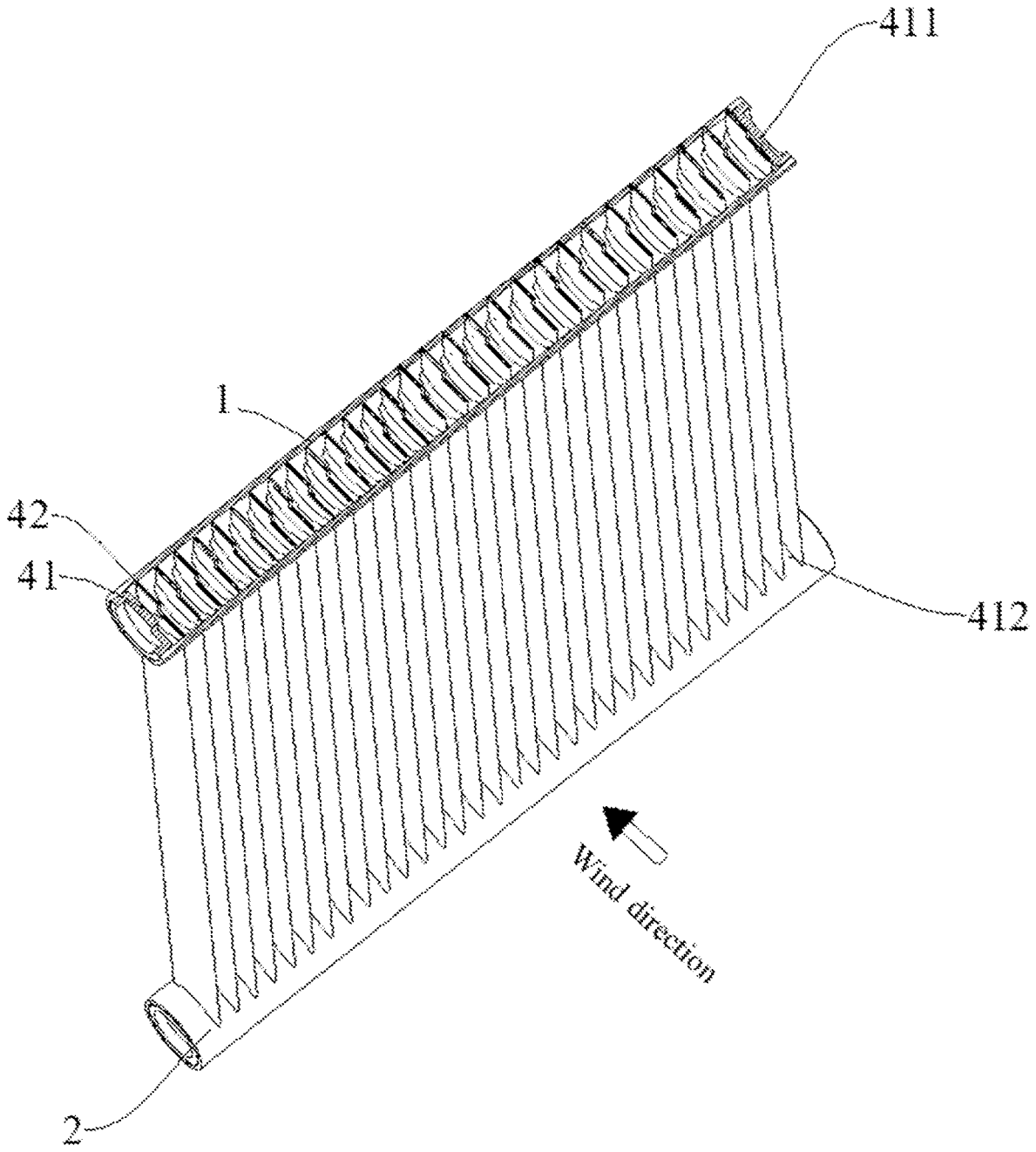
FIG. 2 is a perspective view of a heat exchanger according to another embodiment of the present disclosure, wherein a first tube is located below a second tube, and the first tube is partially sectioned.
Figure 4:
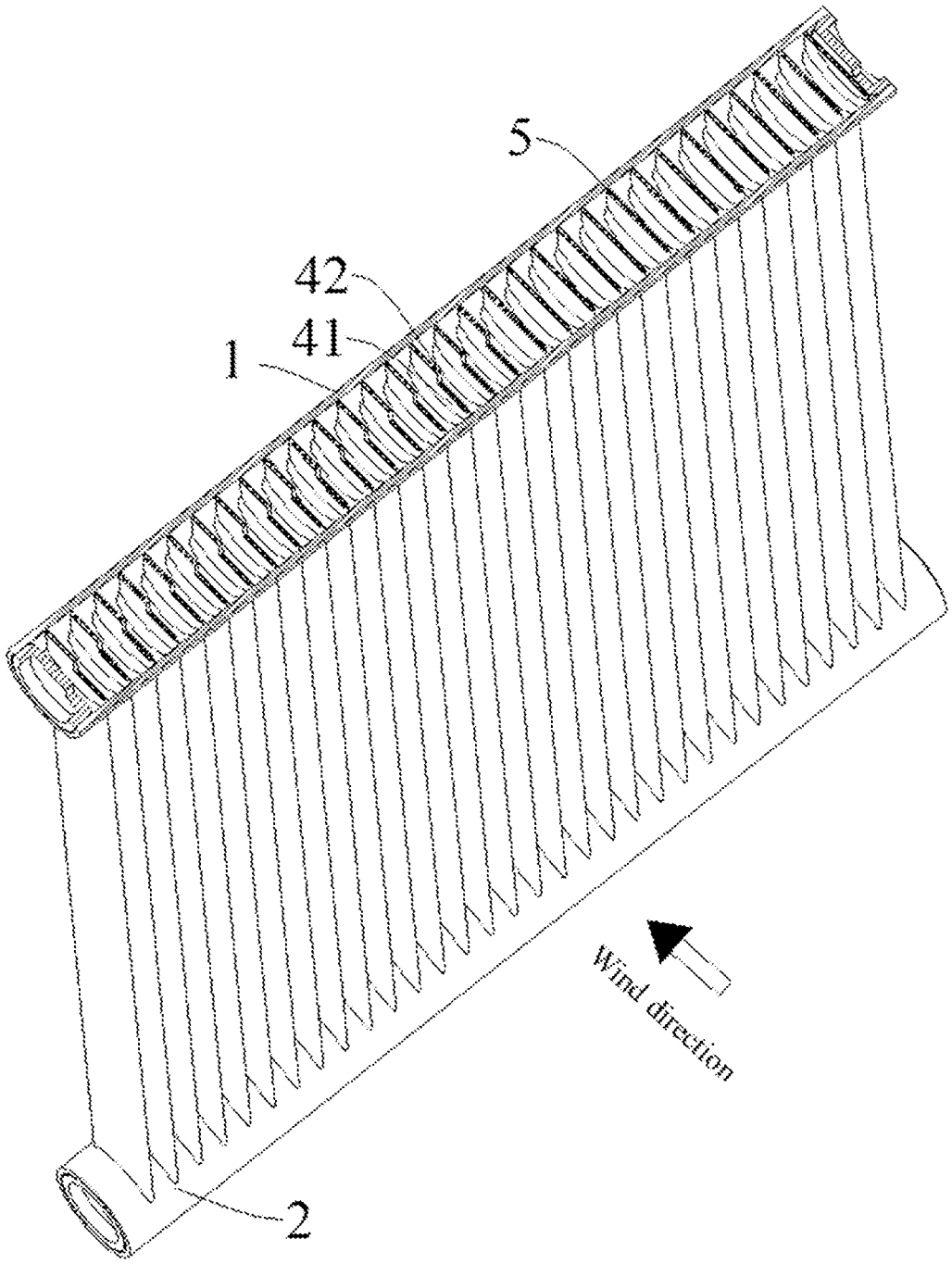
FIG. 4 is a perspective view of a heat exchanger according to another embodiment of the present disclosure, wherein a first tube is located below a second tube, and the first tube is partially sectioned.

This type of heat exchanger 100 has the following forms, one of which is shown in FIG. 2 and FIG. 4. In the height direction of the heat exchanger 100, the first tube 1 is higher than the second tube 2, the first end portion 411 is higher than the second end portion 412, and the length of the first partitioned tube 41 inserted into the tube cavity of the first tube 1 is less than the length of the second partitioned tube 42 inserted into the tube cavity of the first tube 1. For example, this structure is suitable for the heat exchange tube having a structure of a straight tube in a straight line shape, and two ends of the straight tube are connected with the first tube 1 and the second tube 2 in one-to-one correspondence, which may be suitable for the installation in a narrow space, and has the advantage of a small space occupation.

Optionally, a plurality of first heat exchange tubes 4 may be provided, and the plurality of first heat exchange tubes 4 are arranged at intervals along the length direction of the heat exchanger 100.

Alternatively, the first part of the flow inlet of each first heat exchange tube 4 has the height difference relative to the second part of the flow inlet in the height direction of the heat exchanger 100, as shown in FIG. 2.

The heat exchanger 100 may also include a second heat exchange tube 5, and the second heat exchange tube 5 has a flush (i.e. flat) port. That is, a flow inlet of the second heat exchange tube 5 may be arranged without a height difference in the height direction of the heat exchanger, as shown in FIG. 4.

In another form, as shown in FIG. 5, FIG. 6, FIG. 8 and FIG. 9, in the height direction of the heat exchanger 100, the first tube 1 is flush with the second tube 2, the first end portion 411 is higher than the second end portion 412, and the length of the first partitioned tube 41 inserted into the tube cavity of the first tube 1 is less than the length of the second partitioned tube 42 inserted into the tube cavity of the first tube 1. The heat exchanger 100 of this structure is suitable for a place with higher heat exchange efficiency requirements. For example, when the site area is relatively large, and the number of the heat exchangers 100 is strictly limited, this form of heat exchanger 100 may be selected.

Optionally, the first partitioned tube 41 and the second partitioned tube 42 are arranged in parallel.

Figure 3:
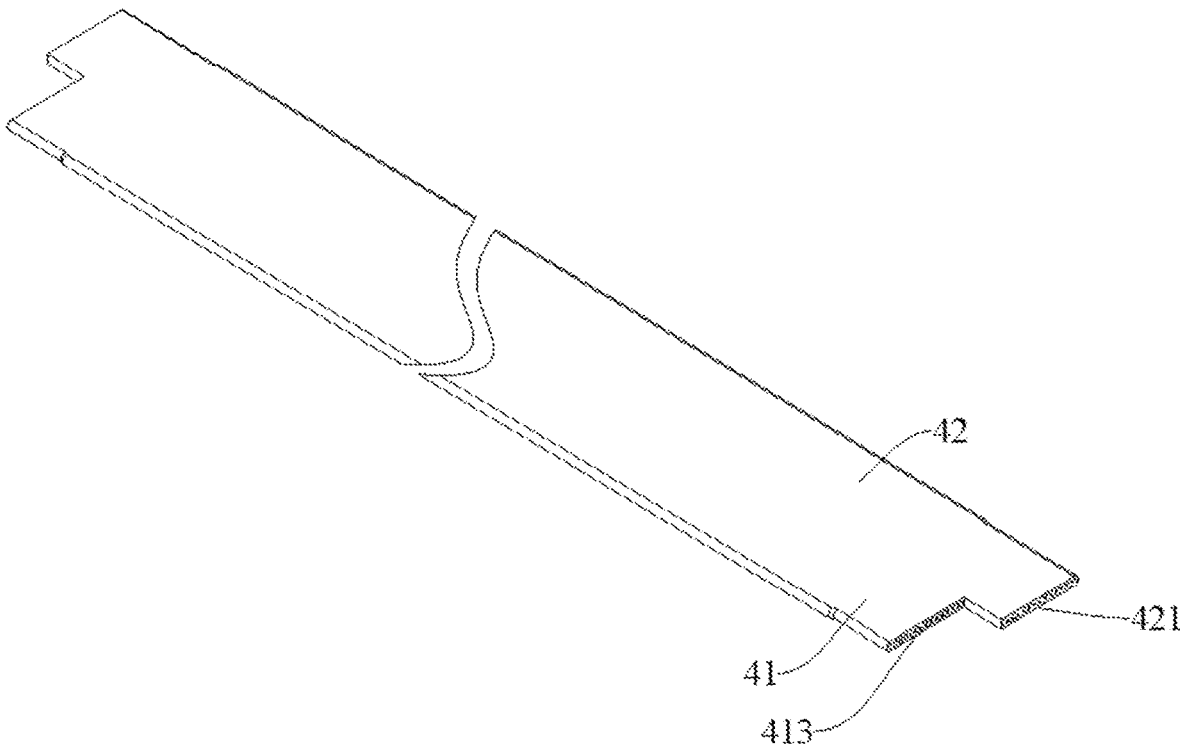
FIG. 3 is a schematic view of a first heat exchange tube in FIG. 2.

The embodiments of the present disclosure are not limited to this. For example, in other embodiments, as shown in FIG. 1 and FIG. 3, the first partitioned tube 41 and the second partitioned tube 42 are arranged in parallel, the first partitioned tube 41 has the first end portion 411 and the second end portion 412 in the height direction of the heat exchanger 100, and the first end portion 411 is inserted in the tube cavity of the first tube 1. In the height direction of the heat exchanger 100, the first end portion 411 is lower than the second end portion 412, and the length of the first partitioned tube 41 inserted into the tube cavity of the first tube 1 is greater than the length of the second partitioned tube 42 inserted into the tube cavity of the first tube 1.

Specifically, this type of heat exchanger 100 has the following forms.

One of the forms is shown in FIG. 1, in the height direction of the heat exchanger 100, the first tube 1 is lower than the second tube 2, the first end portion 411 is lower than the second end portion 412, and the length of the first partitioned tube 41 inserted into the tube cavity of the first tube 1 is greater than the length of the second partitioned tube 42 inserted into the tube cavity of the first tube 1. The heat exchanger 100 of this arrangement is suitable for a situation that a tube structure of the inlet tube 3 is close to the bottom.

Figure 7:
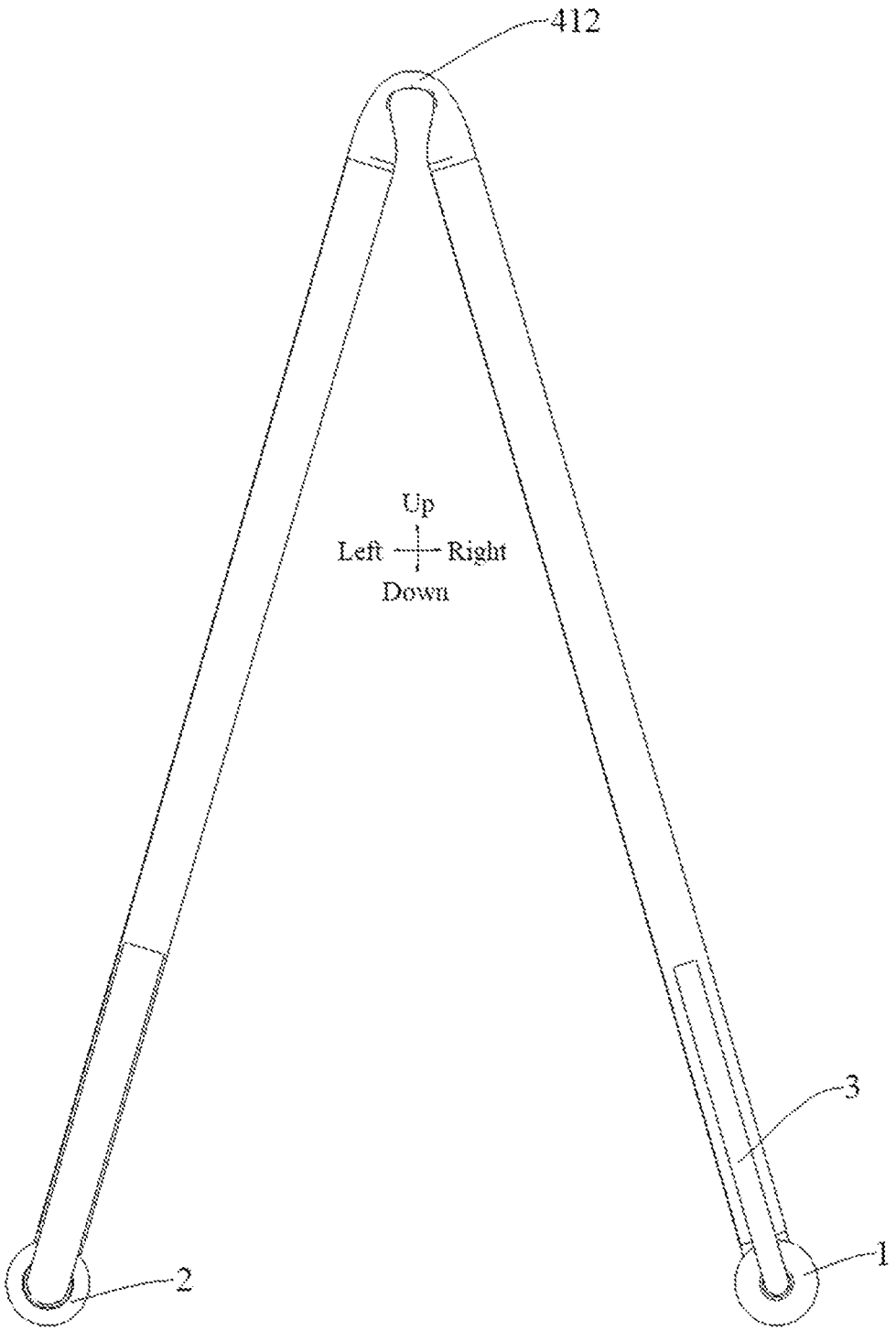
FIG. 7 is a side view of a heat exchanger according to another embodiment of the present disclosure, wherein a first partitioned tube and a second partitioned tube have an inverted V shape.

Another form is shown in FIG. 7, in the height direction of the heat exchanger 100, the first tube 1 is arranged flush with the second tube 2, the first end portion 411 is lower than the second end portion 412, and the length of the first partitioned tube 41 inserted into the tube cavity of the first tube 1 is greater than the length of the second partitioned tube 42 inserted into the tube cavity of the first tube 1. This structure is suitable for an installation place with a large placement space at the bottom and a small placement space at the top.

The embodiments of the present disclosure are not limited to this. For example, as shown in FIG. 8, FIG. 9 and FIG. 14, in other embodiments, the heat exchanger 100 further includes a third partitioned tube 43, a section of the third partitioned tube 43 inserted into the first tube 1 has a third flow inlet 431, and in the height direction of the heat exchanger 100, the third flow inlet 431 is lower than at least one of the first flow inlet and the second flow inlet.

In the width direction of the heat exchanger 100, the first partitioned tube 41, the second partitioned tube 42 and the third partitioned tube 43 are successively arranged, and in the height direction of the heat exchanger 100, the third flow inlet 431 of the third partitioned tube 43 is lower than at least one of the first flow inlet and the second flow inlet. Thus, the distribution of the refrigerant may be better optimized and the heat exchange efficiency of the first heat exchange tube 4 may be improved.

Figure 8:
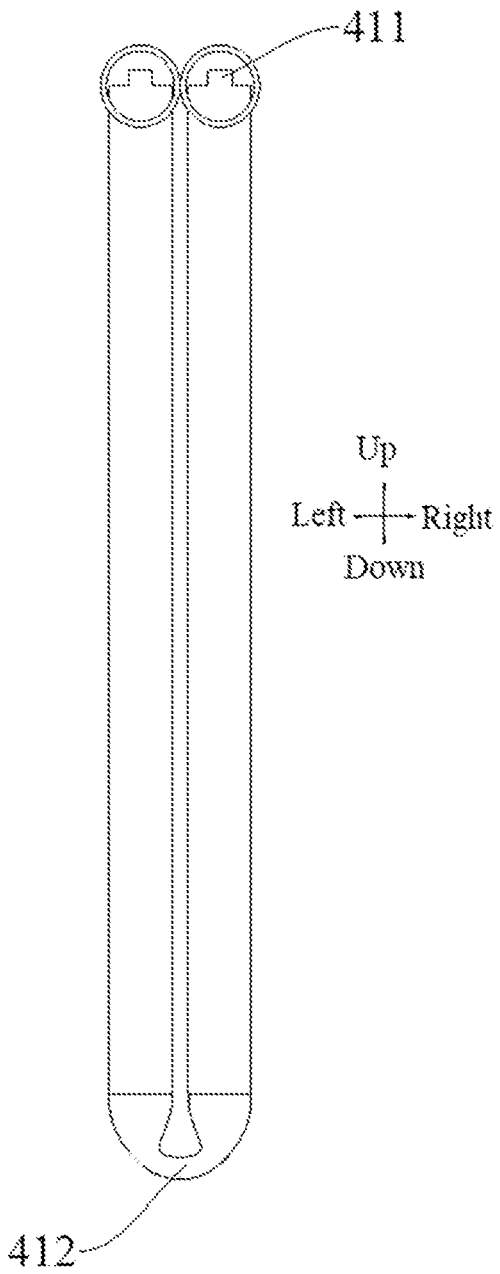
FIG. 8 is a side view of a heat exchanger according to another embodiment of the present disclosure, wherein a first partitioned tube and a second partitioned tube extend along a height direction of the heat exchanger.
Figure 9:
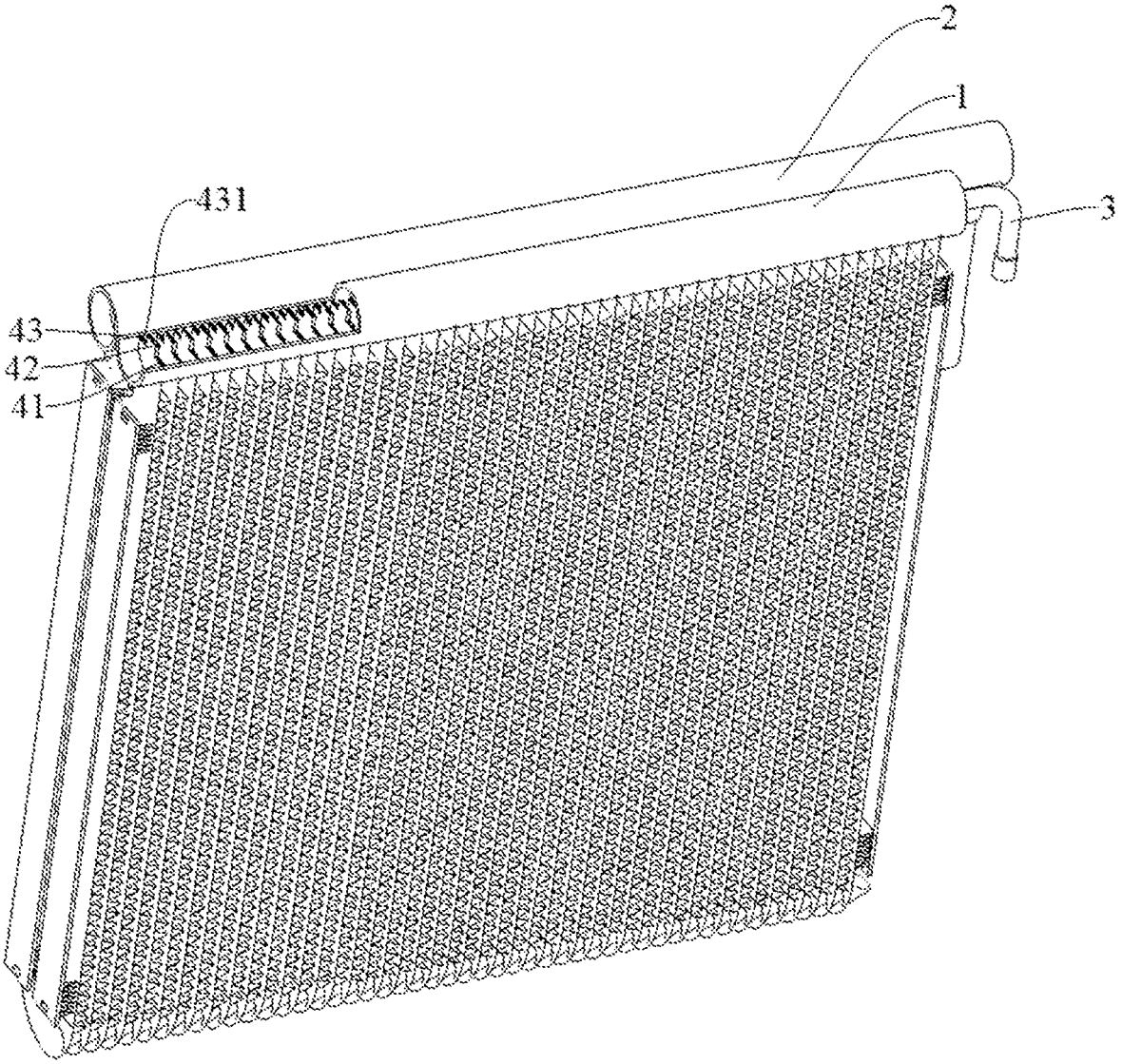
FIG. 9 is a perspective view of the heat exchanger in FIG. 8.
Figure 14:
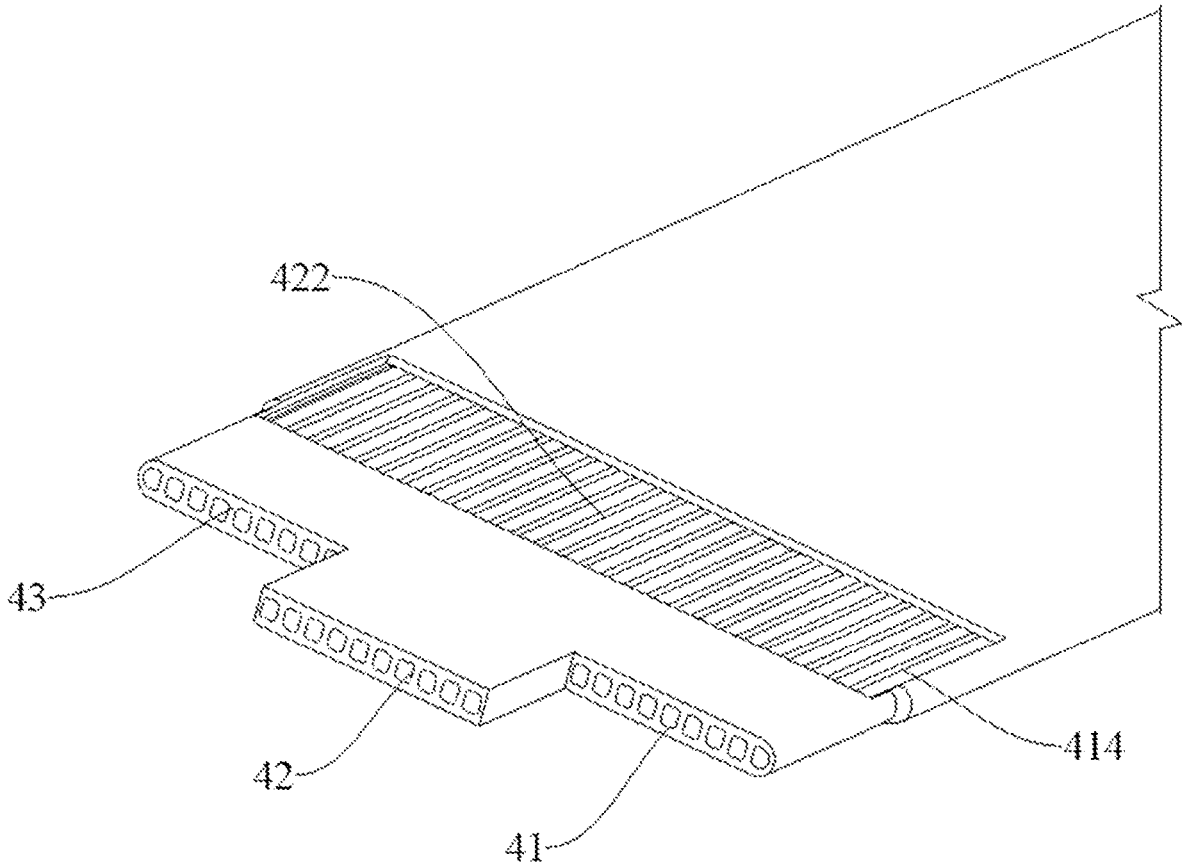
FIG. 14 is a partial view of a fifth form of a first heat exchange tube in the present disclosure.

Specifically, in FIG. 8, FIG. 9 and FIG. 14, in the height direction of the heat exchanger 100, the first tube 1 is higher than or equal to the second tube 2, the first end portion 411 is higher than the second end portion 412, and the third flow inlet 431 of the third partitioned tube in the first tube 1 is lower than at least one of the first flow inlet of the first partitioned tube 41 and the second flow inlet of the second partitioned tube 42.

Figure 17:
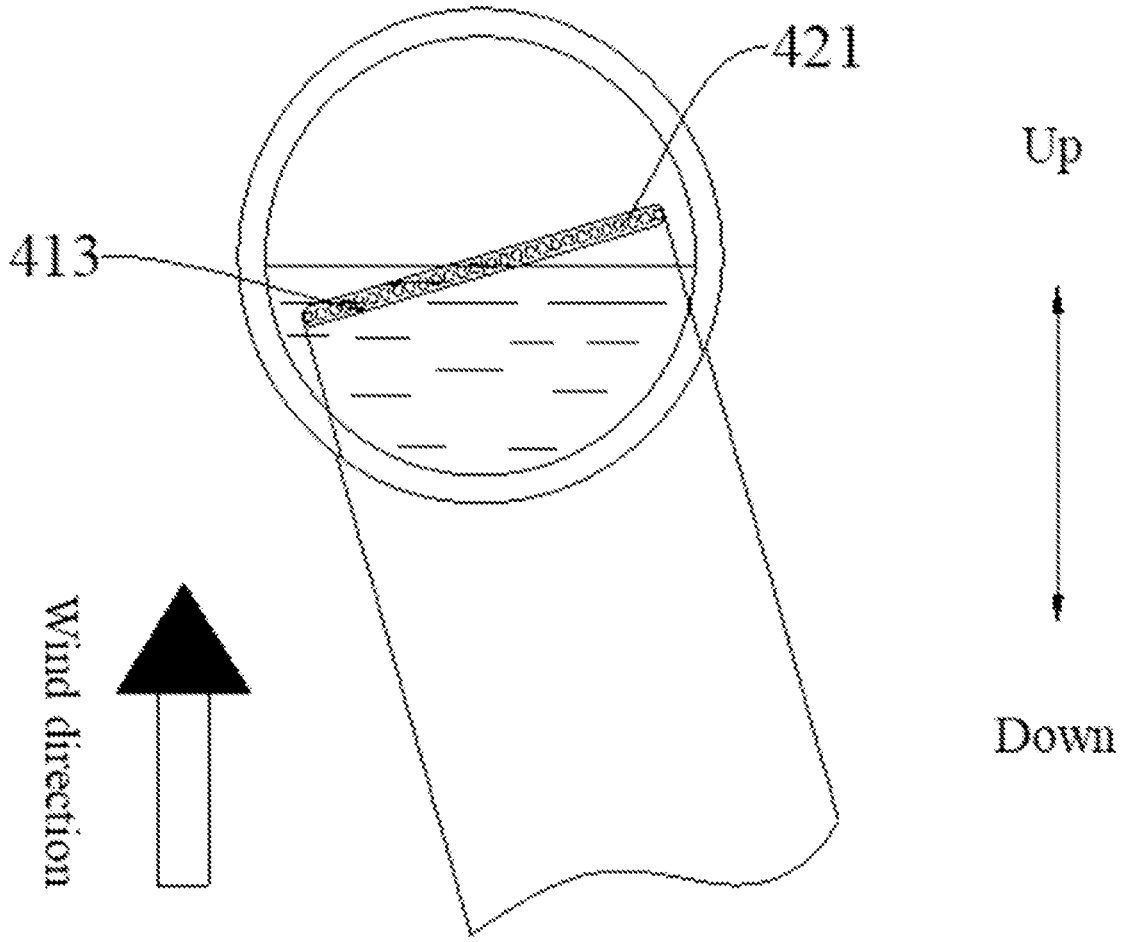
FIG. 17 is a partial view of a sixth form of a first heat exchange tube in the present disclosure, wherein the first heat exchange tube has an inclined port.

As shown in FIG. 8 and FIG. 17, the first flow inlet of the first partitioned tube 41 includes the first port 413 of the first partitioned tube 41 and/or the first flow hole 414 arranged on the first partitioned tube 41, the second flow hole of the second partitioned tube 42 includes the second port 421 of the second partitioned tube 42 and/or the second flow hole 422 arranged on the second partitioned tube 42, and a height of at least part of the first flow hole 414 on the first partitioned tube 41 is less than a height of the second port 421 of the second partitioned tube 42, i.e., the at least part of the first flow hole 414 on the first partitioned tube 41 is lower than the second port 421 of the second partitioned tube 42 in the height direction of the heat exchanger 100.

In other words, the first flow inlet of the first partitioned tube 41 includes the first port 413 of the first partitioned tube 41, or the first flow inlet of the first partitioned tube 41 is arranged at the first through hole 414 of the first partitioned tube 41. Or, the first flow inlet of the first partitioned tube 41 includes the first port 413 of the first partitioned tube 41 and the first flow hole 414 arranged on the first partitioned tube 41. The second flow inlet of the second partitioned tube 42 includes the second port 421 of the second partitioned tube 42, or the second flow inlet of the second partitioned tube 42 is arranged at the second through hole 422 of the second partitioned tube 42. Or, the second flow inlet of the second partitioned tube 42 includes the second port 421 of the second partitioned tube 42 and the second flow hole 422 arranged on the second partitioned tube 42.

Figure 10:
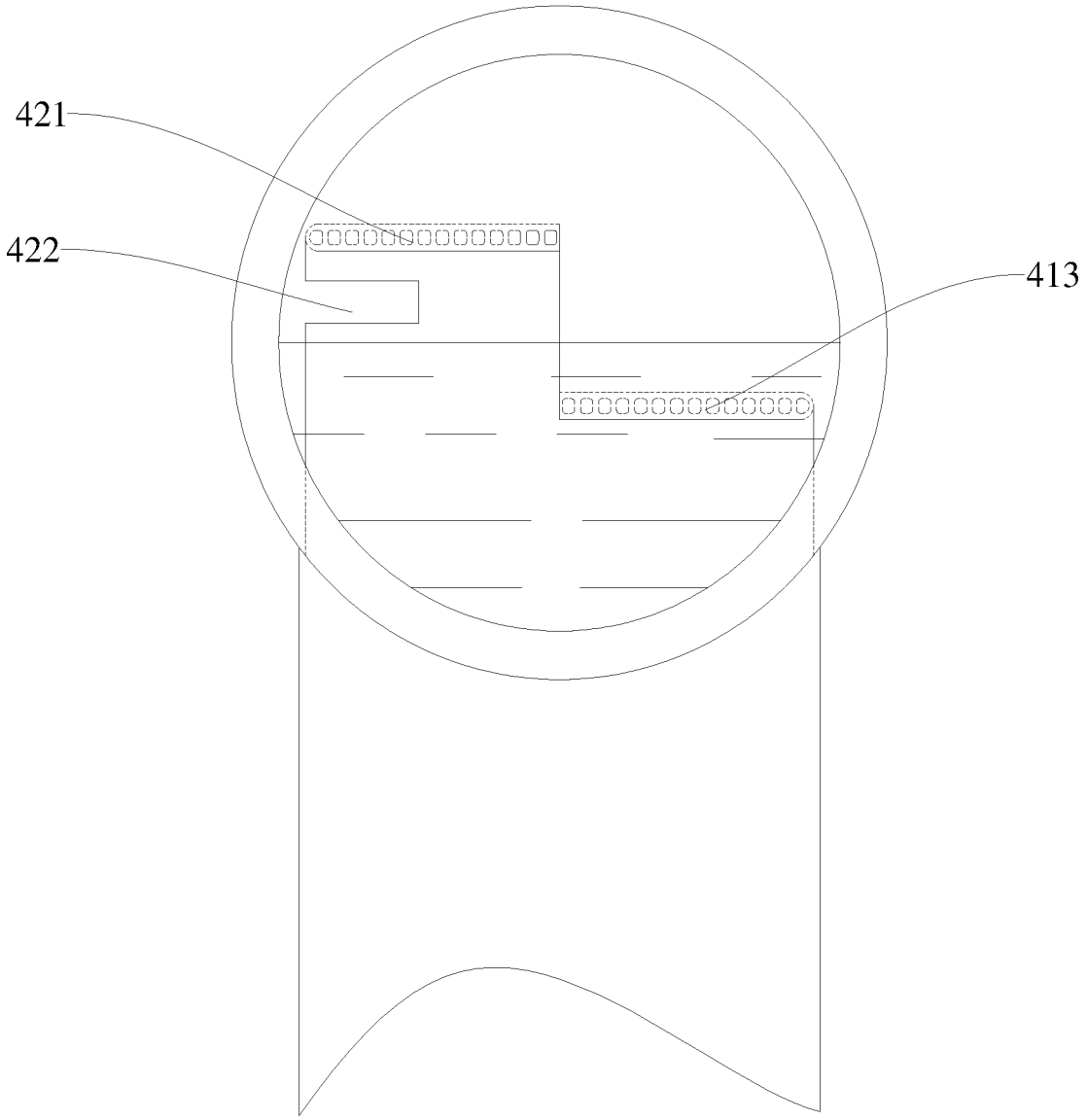
FIG. 10 is a partial view of a first form of a first partitioned tube and a second partitioned tube in the present disclosure.

For example, as shown in FIG. 10, the first flow inlet of the first partitioned tube 41 includes the first port 413 of the first partitioned tube 41, the second flow inlet of the second partitioned tube 42 includes the second port 421 of the second partitioned tube 42 and the second flow hole 422 arranged on the second partitioned tube 42, and the first port 413 of the first partitioned tube 41 is lower than the second flow hole 422 of the second partitioned tube 42 in the height direction of the heat exchanger 100. Therefore, the flow of the refrigerant in the flow channel of the second partitioned tube 42 is improved. Thus, the uniformity of the distribution of the first heat exchange tube 4 is improved.

Figure 11:
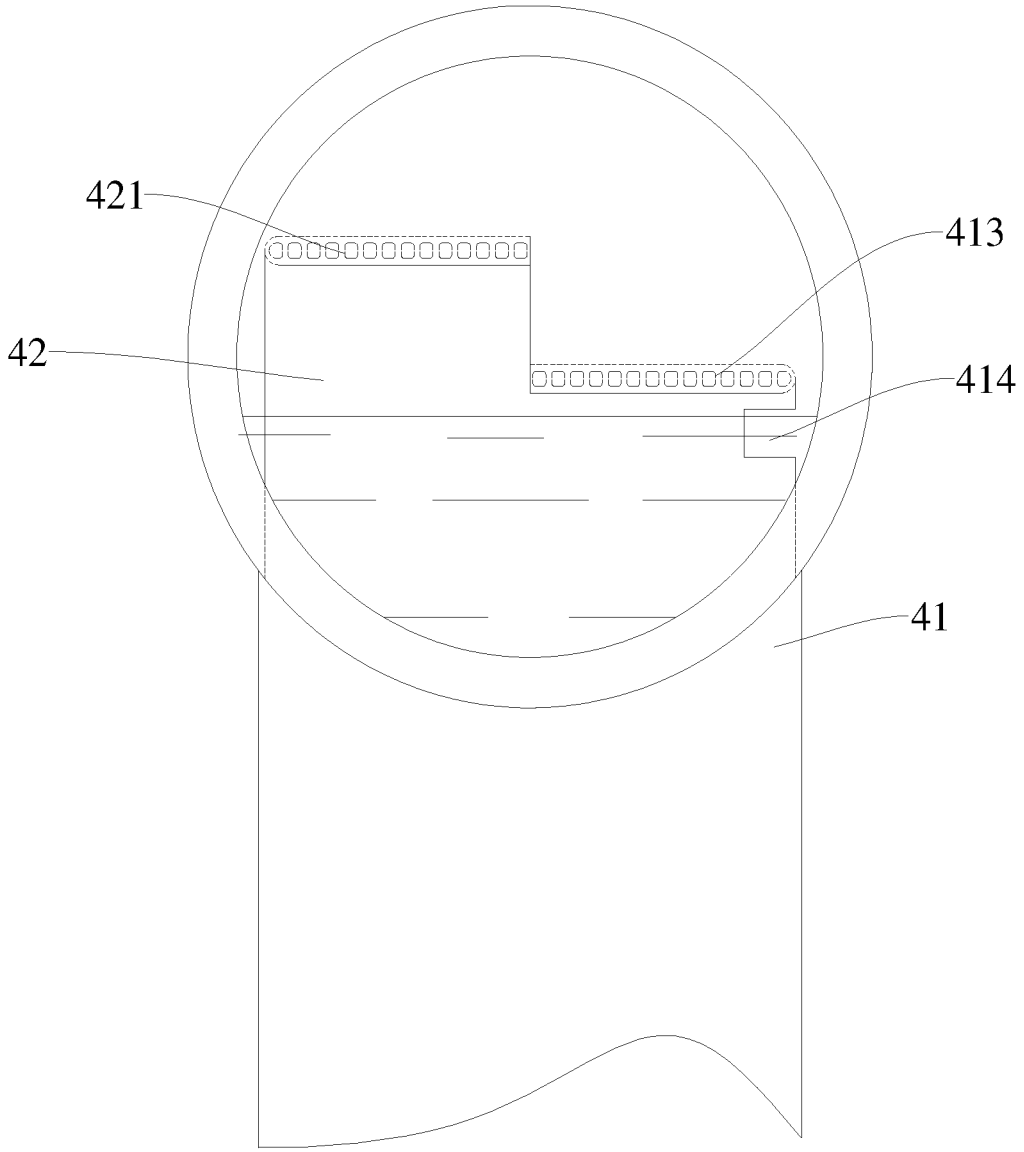
FIG. 11 is a partial view of a second form of a first partitioned tube and a second partitioned tube in the present disclosure.

For example, as shown in FIG. 11, the first flow inlet of the first partitioned tube 41 includes the first flow hole 414 arranged on the first partitioned tube 41 and the first port 413 of the first partitioned tube 41, and the second flow inlet of the second partitioned tube 42 is the second port 421 of the second partitioned tube 42. Each of the first flow hole 414 on the first partitioned tube 41 and the first port 413 of the first partitioned tube 41 is lower than the second port 421 of the second partitioned tube 42 in the height direction of the heat exchanger 100. For example, the first flow inlet of the first partitioned tube 41 includes the first port 413 of the first partitioned tube 41 and the first flow hole 414 arranged on the first partitioned tube 41. The first flow hole 414 and the first port 413 of the first partitioned tube 41 both are lower than the second flow inlet of the second partitioned tube 42 in the height direction of the heat exchanger 100. Therefore, the flow efficiency and the refrigeration efficiency of the refrigerant in the flow channel of the first partitioned tube 41 may be improved.

Figure 12:
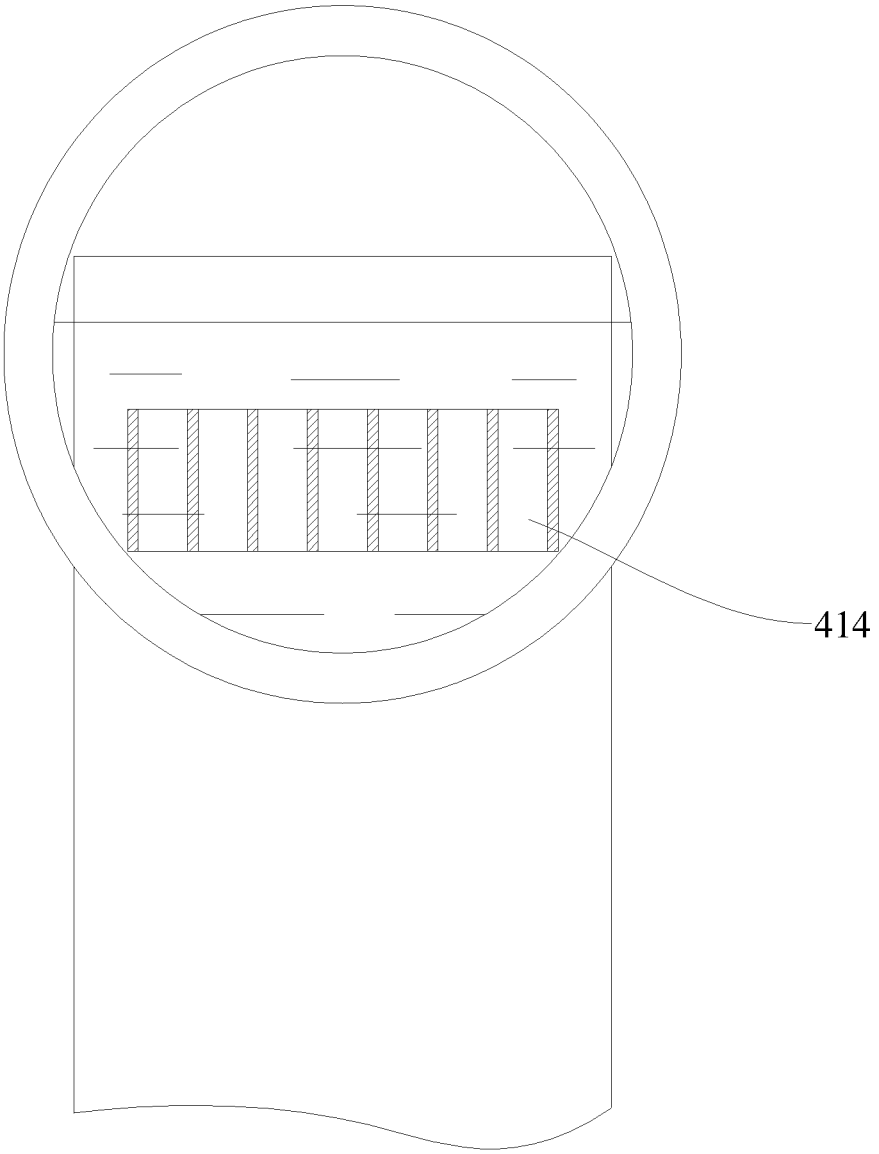
FIG. 12 is a partial view of a third form of a first partitioned tube and a second partitioned tube in the present disclosure.
Figure 13:
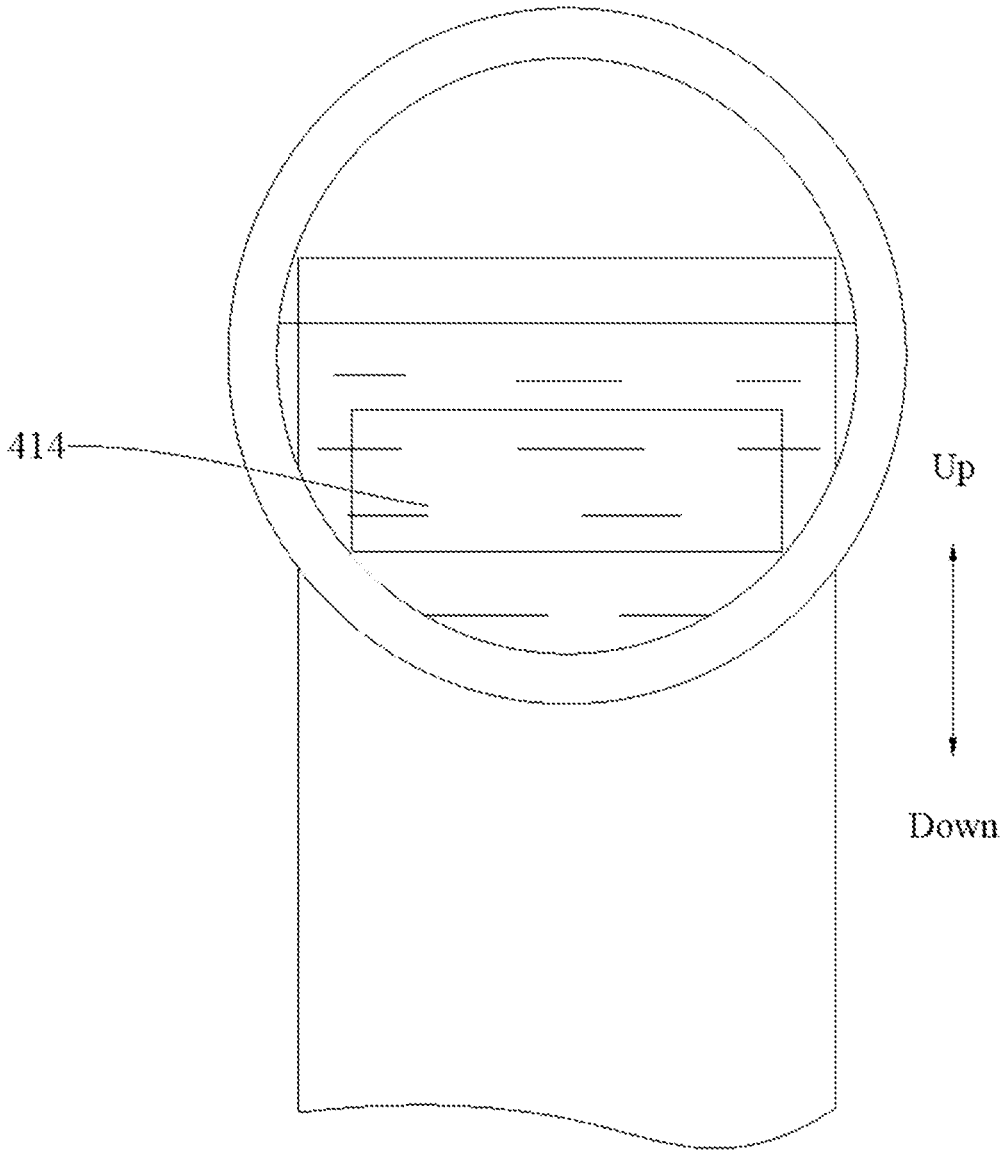
FIG. 13 is a partial view of a fourth form of a first partitioned tube and a second partitioned tube in the present disclosure.

For example, as shown in FIGS. 12 to 13, the first flow inlet of the first partitioned tube 41 is arranged at the first flow hole 414 of the first partitioned tube 41, and the second flow inlet of the second partitioned tube 42 includes the second port 421 of the second partitioned tube 42. A position of the first flow hole 414 is lower than that of the second port 421 of the second partitioned tube 42 in the height direction of the heat exchanger 100. Therefore, the flow efficiency and the refrigeration efficiency of the refrigerant in the flow channel of the second partitioned tube 42 may be improved.

For example, as shown in FIG. 14, the first flow inlet of the first partitioned tube 41 includes the first port 413 of the first partitioned tube 41 and the first flow hole 414 arranged on the first partitioned tube 41, the second flow inlet of the second partitioned tube 42 includes the second port 421 of the second partitioned tube 42 and the second flow hole 422 arranged on the second partitioned tube 42, and the first port 413 of the first partitioned tube 41 is lower than the second port 421 of the second partitioned tube 42 in the height direction of the heat exchanger 100. Therefore, the flow efficiency and the refrigeration efficiency of the refrigerant in each flow channel of the first heat exchange tube 4 may be improved.

A plurality of the first flow holes 414 are provided. It may be that part of the first flow holes 414 on the first partitioned tube 41 are lower than the second port 421 of the second partitioned tube 42 in the height direction of the heat exchanger 100, or it also may be that all the first flow holes 414 on the first partitioned tube 41 are lower than the second port 421 of the second partitioned tube 42 in the height direction of the heat exchanger 100.

Figure 15:
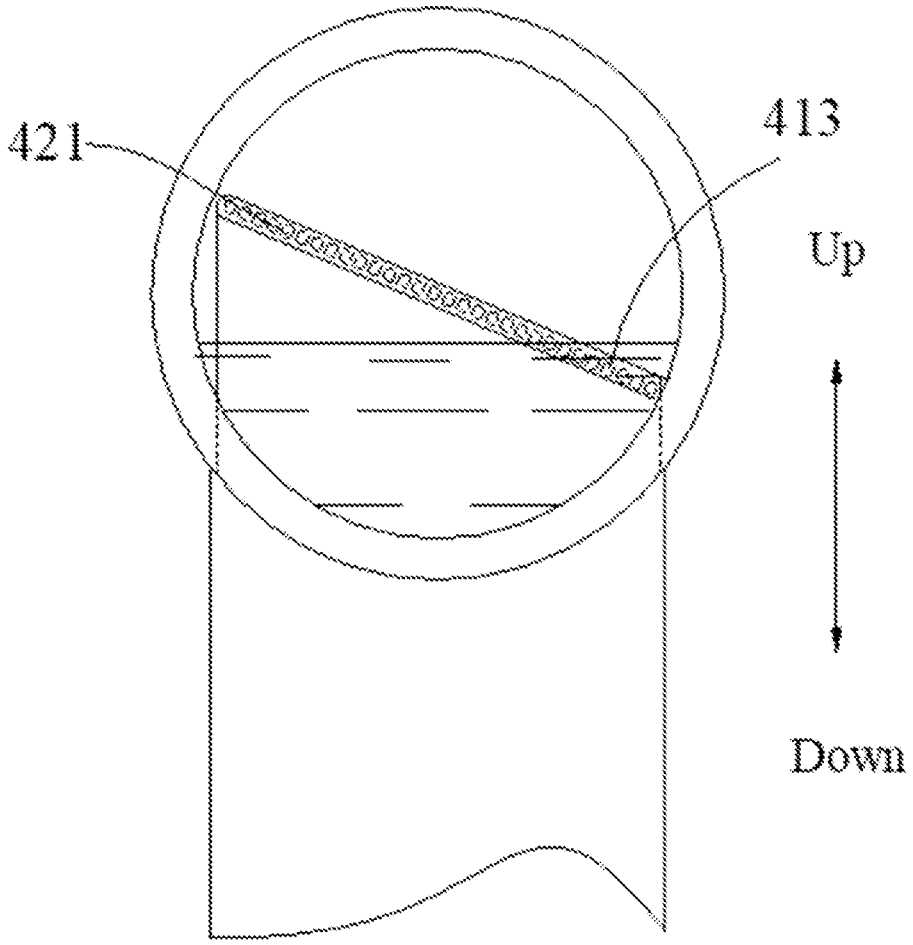
FIG. 15 is a partial view of a sixth form of a first heat exchange tube in the present disclosure, wherein part of the first heat exchange tube is inclined.

As shown in FIG. 15, the first heat exchange tube 4 includes a first tube section extending along the height direction of the heat exchanger 100, and a port of the first tube section is inclined relative to the height direction of the heat exchanger 100, so that one part of the port (for example, the second port 421 of the second partitioned tube 42) has a height difference relative to (i.e. being higher than) the other part of the port (for example, the first port 413 of the first partitioned tube 41) in the height direction of the heat exchanger 100. Thus, one part of an end of a portion exclusive of the first tube section of the tube cavity of the first tube 1 has a height difference relative to the other part of the end of the portion exclusive of the first tube section of the tube cavity of the first tube 1 in the height direction of the heat exchanger 100. Therefore, the first heat exchange tube 4 has the advantages of a simple structure and a processing convenience.

Furthermore, a width direction of the first heat exchange tube 4 (such as the front-rear direction shown in FIG. 1) is consistent with a windward direction, and the first partitioned tube 41 is arranged adjacent to a windward side. Thus, the overall heat exchange efficiency of the first heat exchange tube 4 is further improved.

Specifically, as shown in FIG. 15, in the up-down direction, a lower side of the port of the first heat exchange tube 4 is arranged adjacent to the windward side, so as to be immersed in the liquid refrigerant for exporting the liquid refrigerant, while the port of the first heat exchange tube 4 adjacent to a leeward side is higher, and is above a liquid level of the refrigerant, so as to export the gaseous refrigerant. Due to the fact that the heat exchange efficiency on the windward side is generally higher than that on the leeward side, the flow channel where the liquid refrigerant flows may be matched with the relatively higher heat exchange efficiency on the windward side. Thus, it is conducive to improving the overall heat exchange efficiency of the first partitioned tube 41. Moreover, it further avoids too much gaseous refrigerant in the flow channel of the first heat exchange tube 4 under certain working conditions, which otherwise may disturb the uniformity of the distribution of the liquid refrigerant in the first heat exchange tube 4 (for example, the first partitioned tube 41). Thus, the overall heat exchange efficiency of the first heat exchange tube 4 is further improved.

The embodiments of the present disclosure are not limited to this. For example, in other embodiments, as shown in FIGS. 16 and 17, the first heat exchange tube 4 includes a first tube section inclined relative to the height direction of the heat exchanger 100, the first tube section has a flush port, and the first tube section is inclined relative to the height direction of the heat exchanger 100 so that the inclined flow inlet is formed at the port of the first tube section.

Figure 16:
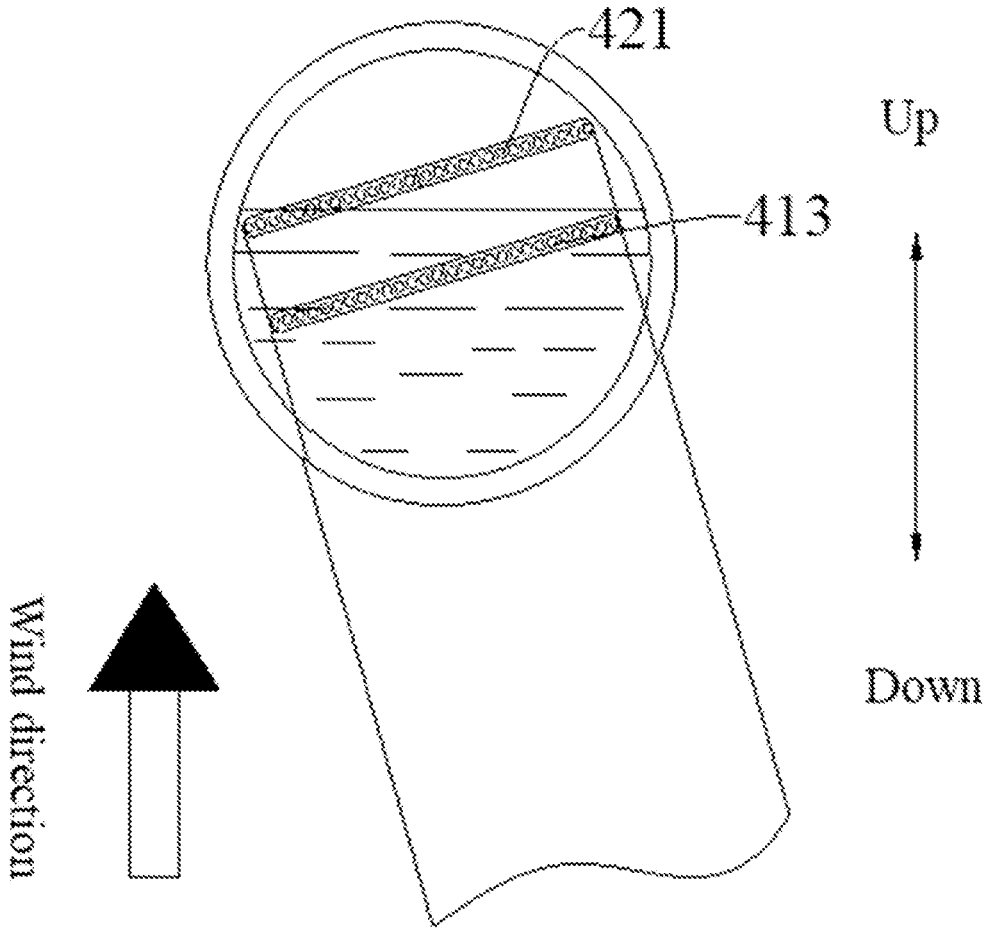
FIG. 16 is a partial view of a sixth form of a first heat exchange tube in the present disclosure, wherein the first heat exchange tube is inclined.

In FIG. 16, a plurality of heat exchange tubes 4 are provided, and the first tube sections of at least two heat exchange tubes 4 are inserted into the first tube 1 by different lengths. Thus, at least part of the port of the first tube section of the heat exchange tube 4, which is inserted into the first tube by a larger length, is above the liquid level of the refrigerant, so as to export the gaseous refrigerant, while the whole port of the first tube section of the heat exchange tube 4, which is inserted into the first tube 1 by a smaller length, is immersed in the liquid refrigerant for exporting the liquid refrigerant.

In this case, the at least part of the port of the first tube section of the heat exchange tube 4, which is inserted into the first tube 1 by a larger length, serves as the second port 421 in terms of their functions, and the whole port of the first tube section of the heat exchange tube 4, which is inserted into the first tube 1 by a smaller length, serves as the first port 413 in terms of their functions.

In FIG. 17, a plurality of heat exchange tubes 4 are provided, and the plurality of heat exchange tubes 4 are inserted into the first tube 1 by the same length. Thus, a lower part of the port of the first tube section of each heat exchange tube 4 is immersed in the liquid refrigerant for exporting the liquid refrigerant, and an upper part of the port of the first tube section of each heat exchange tube 4 is above the liquid level of the refrigerant, so as to export the gaseous refrigerant.

In this case, the lower part of the port of the first tube section of each heat exchange tube 4 serves as the first port 413, and the upper part of the port of the first tube section of each heat exchange tube 4 serves as the second port 421.

In the heat exchanger 100 of the embodiments of the present disclosure, in the height direction of the heat exchanger 100, the first part of the flow inlet of the first heat exchange tube 4 has the height difference relative to the second part of the flow inlet of the first heat exchange tube 4 in the height direction of the heat exchanger 100. Therefore, the gaseous refrigerant in the first tube 1 may be timely discharged through a higher flow channel, which may avoid the problem of uneven distribution of the refrigerant due to cavitation of the gas-liquid mixed refrigerant. Therefore, the heat exchanger 100 in the embodiments of the present disclosure has the advantages of further optimizing the distribution of the refrigerant and improving the heat exchange efficiency of the first heat exchange tube 4.

Figure 5:
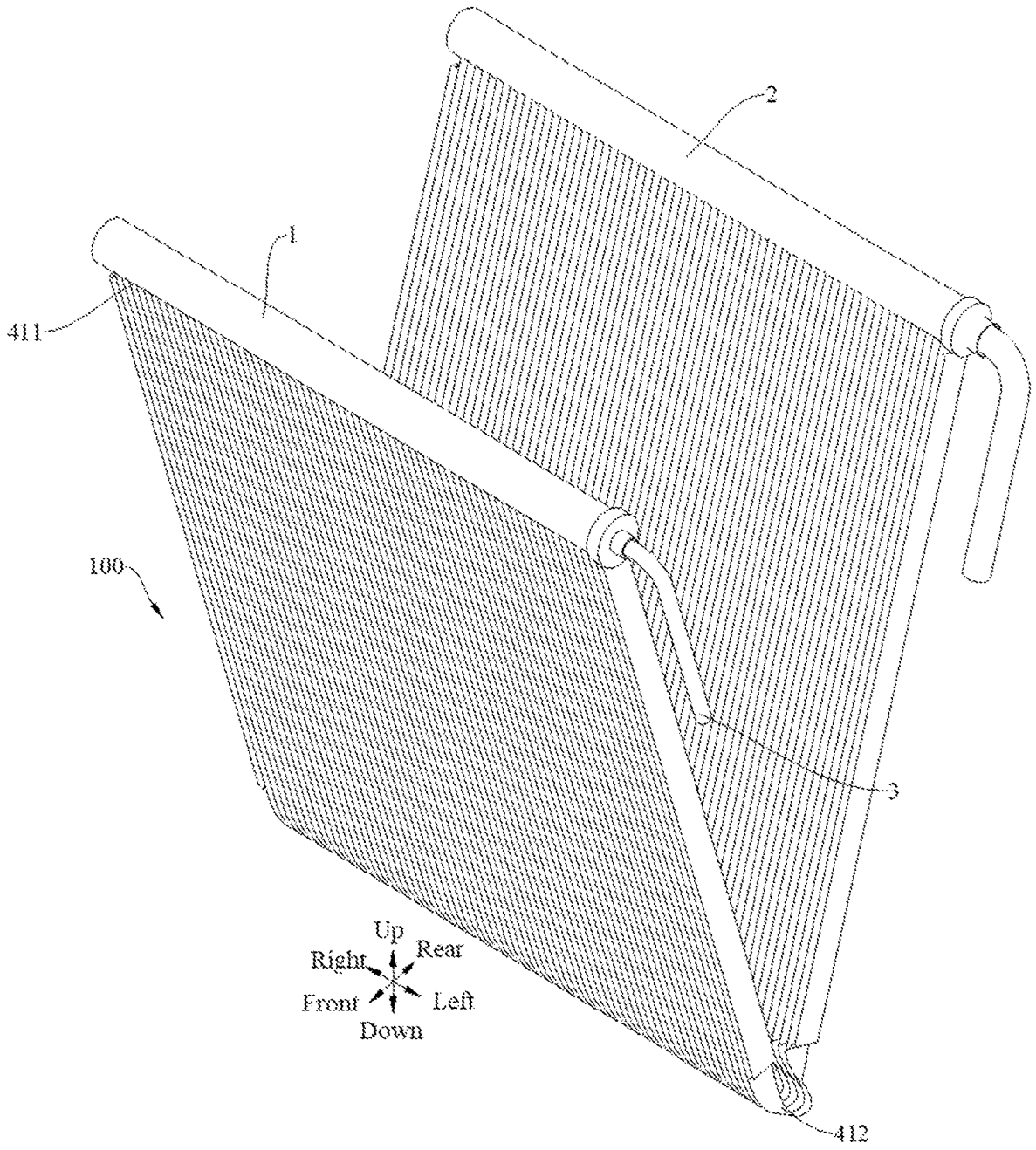
FIG. 5 is a perspective view of a heat exchanger according to another embodiment of the present disclosure, wherein a first partitioned tube and a second partitioned tube have a V shape.
Figure 6:
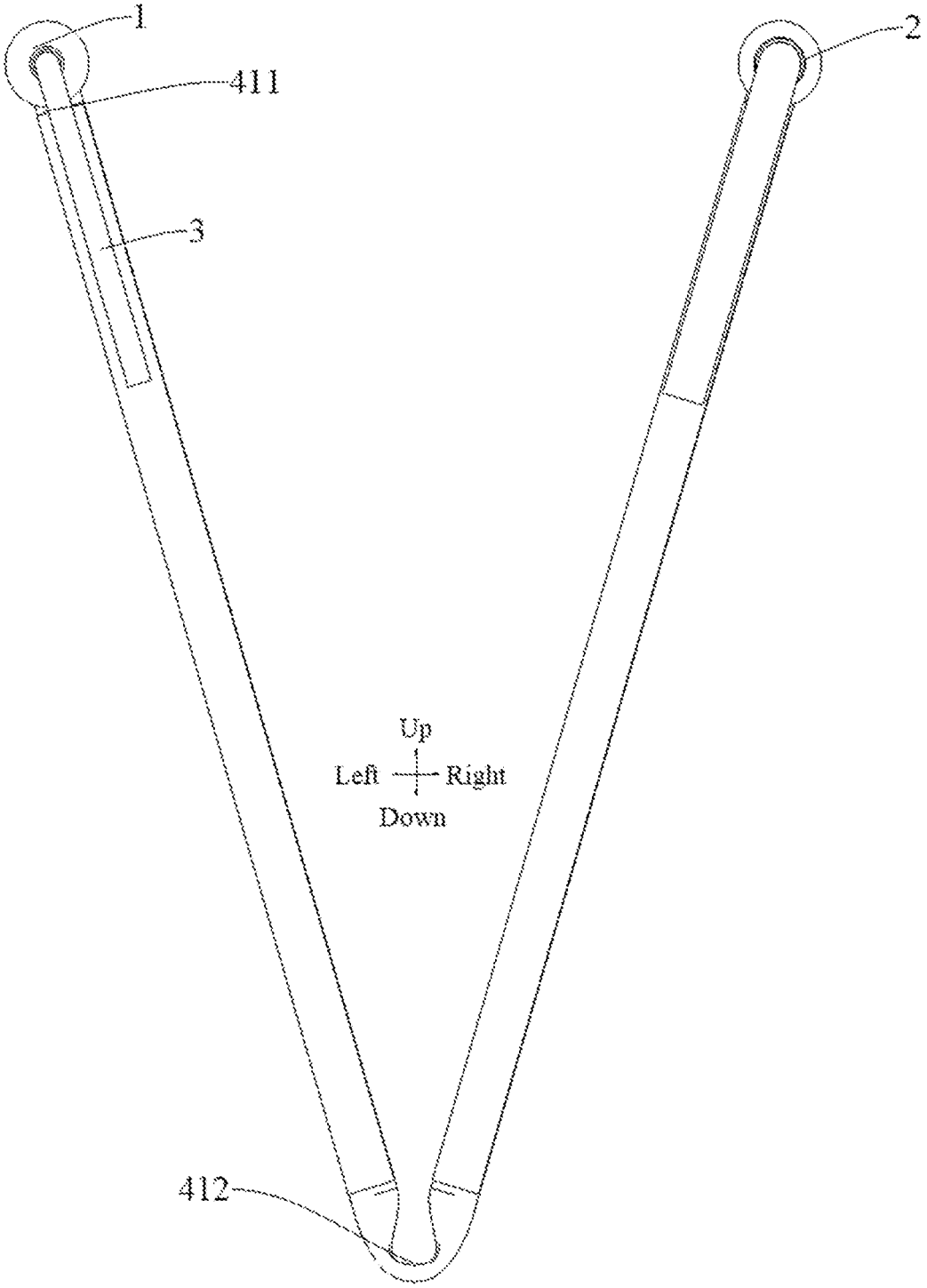
FIG. 6 is a side view of a heat exchanger according to another embodiment of the present disclosure.

For example, the first partitioned tube 41 may be a V-shaped tube, as shown in FIGS. 5 to 7.

The height difference between the first flow inlet of the first partitioned tube 41 and the second flow inlet of the second partitioned tube 42 in the height direction of the heat exchanger 100 is ΔH, and the hydraulic diameter of the first tube 1 is D, which two satisfy a condition: $\frac{1}{12}D<\Delta H<D$.

In the heat exchanger 100 of the embodiments of the present disclosure, the height difference ΔH between the first flow inlet of the first partitioned tube 41 and the second flow inlet of the second partitioned tube 42 in the height direction of the heat exchanger 100 and the hydraulic diameter D of the first tube 1 satisfy the condition: $\frac{1}{12}D<\Delta H<D$, thus avoiding the problem of inability to circulate the refrigerant caused by an end portion of the second partitioned tube 42 abutting against a wall surface of the first tube 1 due to a too large height difference, and also avoiding the inability to achieve the gas-liquid separation due to a too small height difference.

A ratio of a total sectional area of the flow channels in the second partitioned tube 42 to a total sectional area of the flow channels in the first partitioned tube 41 is greater than or equal to 0.05 and less than or equal to 0.5.

In the heat exchanger 100 of the embodiments of the present disclosure, the ratio of the total sectional area of the flow channels in the second partitioned tube 42 to the total sectional area of the flow channels in the first partitioned tube 41 is greater than or equal to 0.05 and less than or equal to 0.5. This may avoid a too large ratio, which otherwise will cause the inability of the liquid refrigerant to enter the part of the first heat exchange tube 4 with the high height and hence cause the problem of the low overall heat exchange efficiency, even though the gaseous refrigerant may be timely exported. Moreover, this may also avoid the problem that the ratio is too small to timely discharge the gaseous refrigerant in the first tube 1, which otherwise will result in poor refrigerant distribution rationality.

As shown in FIGS. 1 to 4, the first partitioned tube 41 and the second partitioned tube 42 each includes a straight section, one end of the straight section is communicated with the first tube 1, and the other end of the straight section is communicated with the second tube 2. Therefore, it has the advantage of a small space occupation.

The embodiments of the present disclosure are not limited to this. For example, in other embodiments, as shown in FIGS. 5 to 8, a plurality of the first partitioned tubes 41 and a plurality of the second partitioned tubes 42 are provided, at least part of each first partitioned tube 41 and at least part of each second partitioned tubes 42 include a bent section formed by bending, one end of the bent section is communicated with the first tube 1, and the other end of the bent section is communicated with the second tube 2.

Specifically, the first partitioned tube 41 may have one of a V shape, a U shape, an S shape, and a serpentine shape, and the second partitioned tube 42 may also have one of a V shape, a S shape and a serpentine shape. Thus, the gaseous refrigerant in the first partitioned tube 41 and the second partitioned tube 42 fully carries out heat exchange with the air.

Optionally, the shape of the first partitioned tube 41 may be consistent with that of the second partitioned tube 42.

In the description of the present disclosure, it should be understood that the orientation or position relationship indicated by the terms "center", "longitudinal", "transverse", "length", "width", "thickness", "up", "down", "front", "rear", "left", "right", "vertical", "horizontal", "top", "bottom", "inner", "outer", "clockwise", "counterclockwise", "axial", "radial" and "circumferential" and the like, is based on the orientation or position relationship shown in the accompanying drawings, which is only for the convenience of describing the present disclosure and simplifying the description, and does not indicate or imply that the referred device or element must have a specific orientation, and be constructed and operated in a specific orientation, so it cannot be understood as a limitation of the present disclosure.

In addition, the terms "first" and "second" are only used for purpose of description, and cannot be understood as indicating or implying relative importance or implicitly indicating the number of indicated technical features. Therefore, the feature defined as "first" or "second" may explicitly or implicitly include at least one such feature. In the description of the present disclosure, "a plurality of" means at least two, such as two, three, etc., unless otherwise specifically defined.

In the present disclosure, unless otherwise expressly defined, terms such as "install/mount", "interconnect", "connect", "fix" shall be understood broadly, and may be, for example, fixed connections, detachable connections, or integral connections; may also be mechanical or electrical connections or intercommunication; may also be direct connections or indirect connections via intervening media; may also be inner communications or interactions of two elements, unless otherwise specifically defined. For those skilled in the art, the specific meaning of the above terms in the present disclosure can be understood according to the specific situations.

In the present disclosure, unless otherwise expressly defined, the first feature "below", "under", "on bottom of", "above", "on", or "on top of" a second feature may include an embodiment in which the first feature is in direct contact with the second feature, or the first feature is in indirect contact with the second feature through an intermediate media. And, the first feature "above", "on", or "on top of" a second feature may include an embodiment in which the first feature is right or obliquely "above", "on", or "on top of" the second feature, or just means that the first feature is at a height higher than that of the second feature. A first feature "below", "under", or "on bottom of" a second feature may include an embodiment in which the first feature is right or obliquely "below", "under", or "on bottom of" the second feature, or just means that the first feature is at a height lower than that of the second feature.

In the description of the present disclosure, terms such as "an embodiment", "some embodiments", "an example", "a specific example" or "some examples" means that a particular feature, structure, material, or characteristic described in connection with the embodiment or example is included in at least one embodiment or example of the present disclosure. Thus, the appearances of these terms in various places throughout this specification are not necessarily referring to the same embodiment or example of the present invention. Furthermore, the particular features, structures, materials, or characteristics may be combined in any suitable manner in one or more embodiments or examples. In addition, without contradiction, those skilled in the art may combine and unite different embodiments or examples or features of the different embodiments or examples described in this specification.

Although the embodiments of the present disclosure have been shown and described above, it can be understood that the above embodiments are illustrative and shall not be understood as limitation to the present disclosure, and changes, modifications, alternatives and variations can be made in the above embodiments within the scope of the present disclosure by those skilled in the art.

The invention claimed is:

1. A heat exchanger, comprising:

a first tube extending along a length direction of the heat exchanger;

a second tube extending along the length direction of the heat exchanger;

an inlet tube connected to the first tube; and a first heat exchange tube having a plurality of flow channels, two ends of the first heat exchange tube being correspondingly inserted into a tube cavity of the first tube and a tube cavity of the second tube, a section of the first heat exchange tube inserted into the tube cavity of the first tube having a flow inlet, and a first part of the flow inlet having a height difference relative to a second part of the flow inlet in a height direction of the heat exchanger, wherein the first heat exchange tube comprises a first partitioned tube and a second partitioned tube successively arranged along a width direction of the heat exchanger, a section of the first partitioned tube inserted into the tube cavity of the first tube has a first flow inlet, a section of the second partitioned tube inserted into the tube cavity of the first tube has a second flow inlet, and the first flow inlet is lower than the second flow inlet in the height direction of the heat exchanger, the first heat exchange tube further comprises a third partitioned tube, a section of the third partitioned tube inserted into the tube cavity of the first tube has a third flow inlet, and in the height direction of the heat exchanger, the third flow inlet is lower than at least one of the first flow inlet and the second flow inlet, and the first partitioned tube, the second partitioned tube and the third partitioned tube are successively arranged in the width direction of the heat exchanger.

2. The heat exchanger according to claim 1, wherein the first partitioned tube has a first end portion and a second end portion in the height direction of the heat exchanger, and the first end portion is inserted in the tube cavity of the first tube, and the first end portion is higher than the second end portion in the height direction of the heat exchanger, and a length of the first partitioned tube inserted into the tube cavity of the first tube is less than a length of the second partitioned tube inserted into the tube cavity of the first tube.

3. The heat exchanger according to claim 2, wherein the first tube is higher than the second tube in the height direction of the heat exchanger.

4. The heat exchanger according to claim 2, wherein the first tube is flush with the second tube in the height direction of the heat exchanger.

5. The heat exchanger according to claim 1, wherein the first partitioned tube has a first end portion and a second end portion in the height direction of the heat exchanger, and the first end portion is inserted in the tube cavity of the first tube, and the first end portion is lower than the second end portion in the height direction of the heat exchanger, and a length of the section of the first partitioned tube inserted into the tube cavity of the first tube is greater than a length of the section of the second partitioned tube inserted into the tube cavity of the first tube.

6. The heat exchanger according to claim 5, wherein the first tube is lower than the second tube in the height direction of the heat exchanger.

7. The heat exchanger according to claim 5, wherein the first tube is flush with the second tube in the height direction of the heat exchanger.

8. The heat exchanger according to claim 1, wherein the first flow inlet of the first partitioned tube comprises at least one of a port of the first partitioned tube and a first flow hole arranged on the first partitioned tube, the second flow inlet of the second partitioned tube comprises at least one of a port of the second partitioned tube and a second flow hole arranged on the second partitioned tube, and at least part of the first flow hole on the first partitioned tube is lower than the port of the second partitioned tube in the height direction of the heat exchanger.

9. The heat exchanger according to claim 1, wherein a height difference between a length of the first partitioned tube inserted into the tube cavity of the first tube and a length of the second partitioned tube inserted into the tube cavity of the first tube is $\Delta H$, a hydraulic diameter of the first partitioned tube is D, and the $\Delta H$ and the D satisfy a condition: $\frac{1}{12}D<\Delta H<D$.

10. The heat exchanger according to claim 1, wherein a ratio of a total sectional area of the plurality of flow channels in the second partitioned tube to a total sectional area of the plurality of flow channels in the first partitioned tube is greater than or equal to 0.05 and less than or equal to 0.5.

11. The heat exchanger according to claim 1, wherein each of the first partitioned tube and the second partitioned tube comprises a straight section, one end of the straight section is communicated with the first tube, and another end of the straight section is communicated with the second tube.

12. The heat exchanger according to claim 1, wherein a plurality of first partitioned tubes and a plurality of second partitioned tubes are provided, at least part of each of the plurality of first partitioned tubes and at least part of each of the plurality of second partitioned tubes comprise a bent section, one end of the bent section is communicated with the first tube, and another end of the bent section is communicated with the second tube.

13. The heat exchanger according to claim 1, wherein the first heat exchange tube comprises a first tube section extending along the height direction of the heat exchanger, and a port of the first tube section is inclined relative to the height direction of the heat exchanger, so that one part of the port of the first tube section has a height difference relative to another part of the port of the first tube section in the height direction of the heat exchanger.

14. The heat exchanger according to claim 1, wherein the first heat exchange tube comprises a first tube section inclined relative to the height direction of the heat exchanger, and the first tube section has a flush port, so that the flow inlet that is inclined is formed at a port of the first tube section.

15. The heat exchanger according to claim 1, further comprising a second heat exchange tube, wherein the second heat exchange tube has a flush port.

* * * * *